United States Patent [19]

Takeuchi

[11] 4,295,565

[45] Oct. 20, 1981

[54] FILM CONTAINING MAGAZINE

[75] Inventor: Kiyoyuki Takeuchi, Otawara, Japan

[73] Assignee: Tokyo Shibaura Denki Kabushiki Kaisha, Japan

[21] Appl. No.: 69,512

[22] Filed: Aug. 24, 1979

[30] Foreign Application Priority Data

Aug. 31, 1978 [JP] Japan ..... 53/106449

[51] Int. Cl.[3] ..... B65D 85/30; B65D 83/08

[52] U.S. Cl. ..... 206/455; 206/586; 206/817; 221/307; 312/71

[58] Field of Search ..... 206/455, 39, 39.4, 817, 206/586; 221/307, 308, 232; 312/71

[56] References Cited

U.S. PATENT DOCUMENTS

| | | | |
|---|---|---|---|
| 180,984 | 8/1876 | Beebe et al. | 206/817 |
| 2,301,893 | 11/1942 | Lifshey | 221/232 |
| 3,462,044 | 8/1969 | McKenna | 221/308 |
| 3,568,884 | 3/1971 | Petricek, Sr. | 221/307 |
| 3,955,092 | 5/1976 | Hubert | 206/455 |
| 4,045,102 | 8/1977 | Austin | 206/39 |

FOREIGN PATENT DOCUMENTS

| | | | |
|---|---|---|---|
| 53-31741 | 8/1978 | Japan | 206/455 |

*Primary Examiner*—William T. Dixson, Jr.
*Attorney, Agent, or Firm*—Finnegan, Henderson, Farabow, Garrett & Dunner

[57] ABSTRACT

A magazine for containing sheet films in a stack for use in an X-ray photographing machine has a substantially U-shaped, plate like pad mounted on the top plate of a casing of the magazine. The arm sections with narrow widths of the U-shaped pad are disposed on the side portions of the inner wall of the top plate along the longitudinal axis of the magazine. The free ends of the arm sections extend up to the edge of the top plate for partially delineating the edge of an opening for film passage. Through the opening, a sheet film is pulled out from the magazine, while sliding on the pad.

10 Claims, 4 Drawing Figures

FILM CONTAINING MAGAZINE

BACKGROUND OF THE INVENTION

The present invention relates to a film containing magazine for use in an X-ray photographing machine of a type in which sheet films are taken out sheet by sheet from a magazine containing a number of sheet films in a stack for each X-ray photographing.

An example of the construction of this type X-ray photographing machine using this sheet films or cut films illustrated in FIG. 1 will be described in brief for assisting a better understanding of the background of the invention.

In the figure, a designates a movable frame of the machine; b a support frame to bear or support the movable frame a; c a table top on which an examinee d lies; e an X-ray source; f an image intensifier device mounted on the movable frame and disposed on the other side of the examinee d facing the X-ray source e.

The movable frame a, together with the support frame b, can rotate about the examinee d in the arrow g direction and also is slidable in the direction longitudinal to the examinee d (perpendicular to the surface of the drawing or this paper). Additionally, the movable frame a, independently of the support frame b, can get closer to or farther from the examinee d, upward and downward in the arrow h direction.

In the movable frame a, a linear path j is defined for a film carrier i. The film carrier is normally in a stand-by position l. Unexposed sheet films p in the supply magazine are taken out sheet by sheet by a vacuum sucker q and sent into the carrier through paired rolls r. When it returns to the stand-by position l and goes through the paired rolls r and a guide path s to be collected in a take-up magazine m. A changeover plate t switches between forward feed and reverse feed of films.

Let us consider a case where, in such an X-ray photographing machine, the movable frame a is rotated or rocked and the magazines m and n are rotated by 180° from the positions shown in FIG. 1 with their openings u and v facing downward, that is to say, these magazines are placed upside down, and under this condition the sheet films are taken in and out from the magazines. In this case, the stacked sheet films p in the respective magazines are stacked on the inner walls of the top plates w of the magazine casings.

Accordingly, when the sheet film p is pulled out from the film supply magazine m, a sheet film to be taken out is fully in contact with the inner wall of the top plate w due to the weight of the stacked films thereby to create a great friction therebetween. Particularly, one end of the film extending into the opening hangs down in the opening due partly to the weight of the film stack exerted on the sheet film. For this, when taken out, the film is subject to a strong weight particularly at the film portion in contact with the edge of the opening, causing scratches on the film surface due to the scraping of the film with the opening edge and increasing the blackening of the film due to a local undue pressure on the film. This results in an unclear X-ray photographing image and thus leads possibly to an erroneous diagnosis. This is a very serious problem in this field.

SUMMARY OF THE INVENTION

Accordingly, an object of the invention is to provide an improved film containing magazine which ensures a smooth take-out of the film irrespective of posture of the magazine and minimizes scratching or the blackening particularly on the major or important central part of the film.

To achieve the object of the invention, on the inner wall of a top plate of the magazine casing is mounted or disposed a U-shaped, plate like resilient pad made of, for example, sponge rubber as a buffering member.

With the provision of the resilient pad, when the magazine is positioned with its opening facing downwardly, the stacked sheet film is directly in contact with the resilient pad and not the inner wall of the top plate. As a result, at the time of the take-out of the film, the film smoothly slides on the resilient pad to smoothly be pulled out from the magazine. Further, in the area near the opening, the film being pulled out contacts only at both side portions with the resilient pad. Therefore, in addition to the smooth pull-out of the film due to the reduction of the contact area, the film containing magazine of the invention has beneficial effects; no scratch and no blackening are created on the important central part of the film.

Other object and features of the invention will be apparent from the following description in connection with the accompanying drawings, in which:

DESCRIPTION OF THE PREFERRED EMBODIMENT

A preferred embodiment of a film containing magazine according to the invention will be described in detail with reference to FIGS. 2 to 4.

Figure 1:
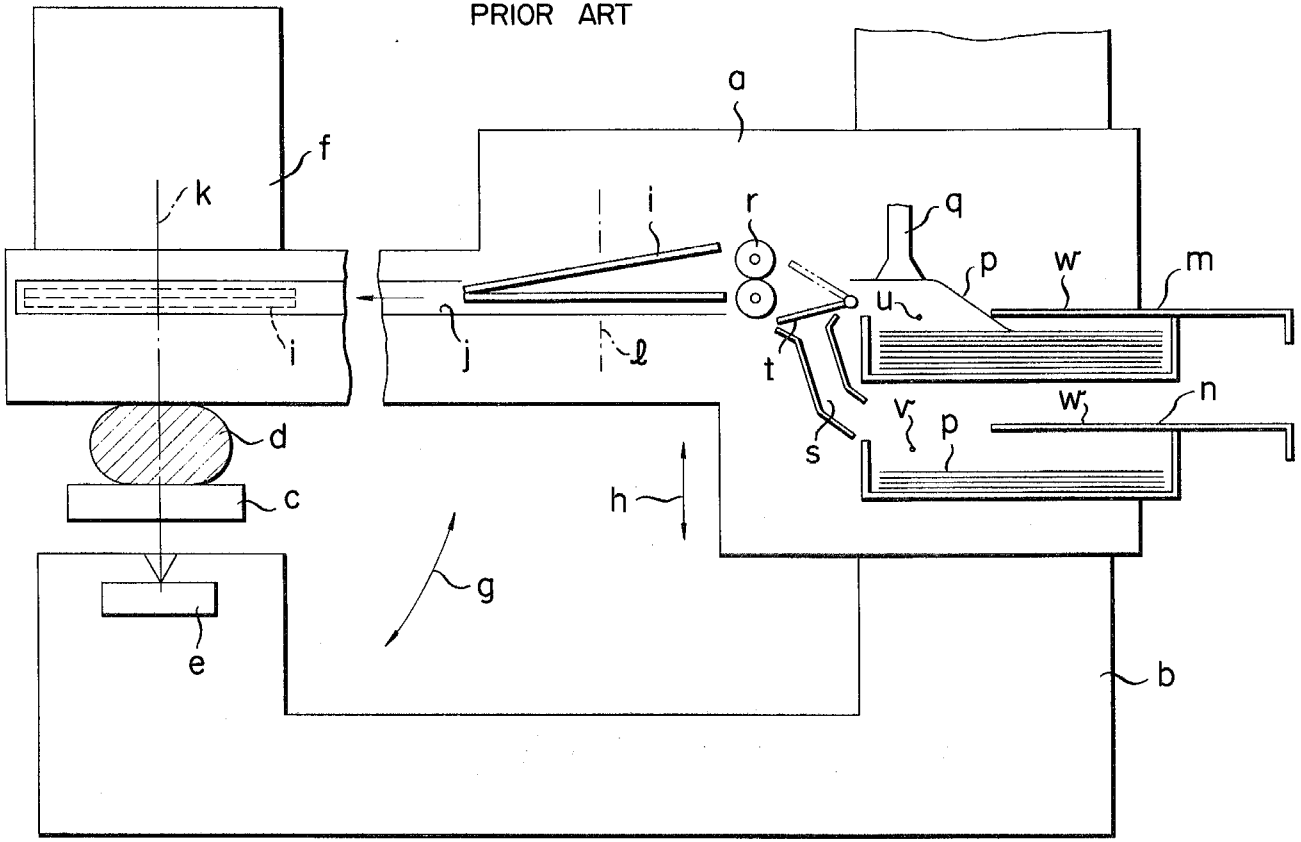
FIG. 1 PRIOR ART
FIG. 1 shows a schematic representation of an X-ray photographing machine of the prior art.

A film containing magazine 10 according to the invention, perspectively illustrated, is well adaptable for an X-ray photographing machine as shown in FIG. 1. The magazine 10 of the invention may be used as or applied for either a supply magazine for containing unexposed sheet films or a takeup magazine for exposed sheet films. The invention is embodied as the film supply magazine only by way of example in the specification.

Figure 2:
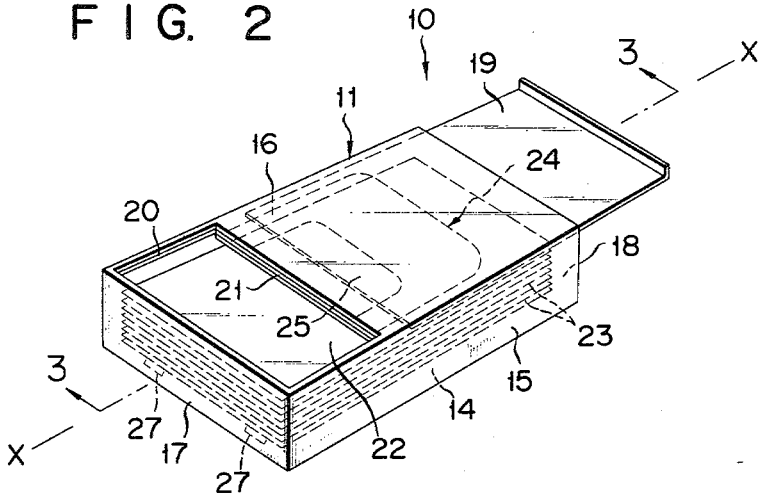
FIG. 2 shows a perspective view of a film containing magazine according to the invention.

In FIG. 2, line X—X is assumed to be the longitudinal axis of the film containing magazine 10. A casing 11 of the magazine 10 parallelepiped has along the longitudinal axis X—X inner and outer top plates 12 and 13, both cooperatively forming a top plate of double structure, a bottom plate 14, paired side plates 15 and 16, and crosswise of the longitudinal axis X—X front and back plates 17 and 18. A lid plate 19 is slidably disposed between the inner and the outer top plates 12 and 13. Guide grooves 20 formed in the inner walls of the side plates 15 and 16 and the front plate 17 cooperatively guide the sliding of the lid plate 19 for opening and closing a square opening 22 defined by the top edges of the side plates 15 and 16 and the front plate 17, and the end edges 21 of the inner and the outer top plates 12 and 13, as shown. In the figure, the opening 22 is illustrated in an open state. Through the opening 22, sheet films 23 stacked in the casing 11 are taken out sheet by sheet from the casing 11 by means of paired feed rolls (not shown) in the arrow direction, as illustrated by a chain line in FIG. 3.

On the inner wall 12*a* of the inner top plate 12 is bonded a U-shaped, plate like resilient pad member 24 as a buffer member by means of suitable adhesive. The pad member 24 is made of sponge rubber material and a sheet or film coated with Teflon (trade mark) for wrapping the sponge rubber material.

Figure 4:
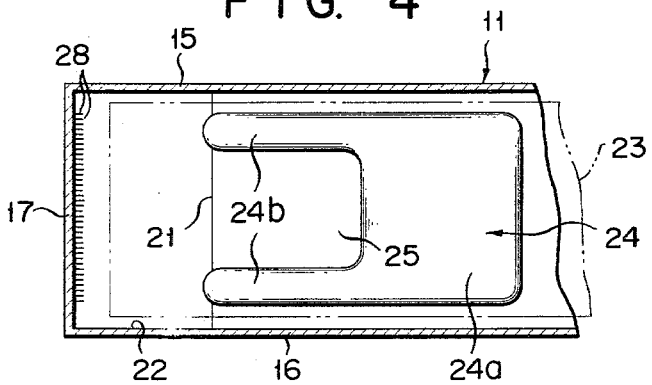
FIG. 4 shows a partial, broken cross sectional view along line 4—4 in FIG. 3.

As well illustrated in FIGS. 2 and 4, a base section 24*a* of the pad member 24 is relatively wide in the direction directed crosswise of the longitudinal axis X—X. A couple of relatively narrow arm sections 24*b* extend from both end portions of one side of the base section 24*a* to the left as viewed in the drawing, with free ends of the arm sections 24*b* extending slightly beyond the end edges 21 of the inner and the outer top plates into the opening 22.

Thus, a depression 25 is formed between both the arm sections 24*b*.

The entire peripheral edge of the pad member 24 is rounded. The sheet films stacked in the magazine casing 11 are biased against the pad member 24 by urging means such as a plurality of leaf springs 27 disposed between a back-up plate 26 within the casing 11 and the bottom plate 14. The leaf springs 27 are fixed at the one ends to the bottom plates, as shown in FIG. 3.

Accordingly, the uppermost sheet film 23 is uniformly in contact with the lower surface of the pad member 24 because of the resiliency of the pad member. With this construction, even when the magazine 10 is positioned with its opening 22 facing upward, the films do not come out from the casing 11, and the registration of the end edges of the stacked films is little damaged.

Figure 3:
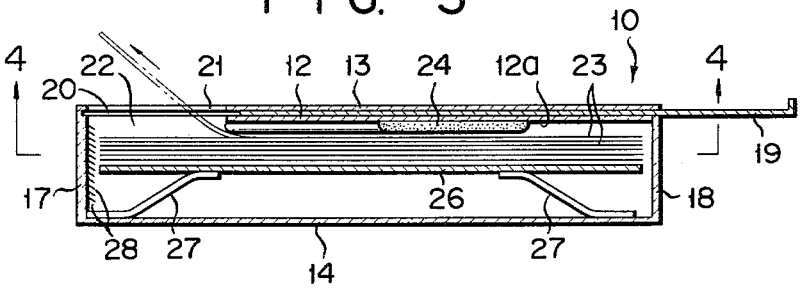
FIG. 3 shows an enlarged cross sectional view taken along line 3—3 in FIG. 2.

In order to further improve the effects just mentioned, a brush like resilient fiber elements 28 may be planted in the inner wall or surface of the front plate 17, as shown in FIG. 3. The fiber elements 28 are inclined toward the bottom plate 14. By engaging the elements 28 with the corresponding end edges of the containing films 23, the films are prevented from hanging down in the opening 22. Because of the sufficient resiliency of the engaging elements 28, however, the engaging elements does not hinder the take-out of the film.

When the sheet film is pulled out in the direction of an arrow, as indicated by a chain line in FIG. 3, the film pulled out slides in contact with the pad member 24 under a slight uniform pressure. In the area near the end edge 21 of the opening 22, the film 23 slides in contact with only the narrow arm sections 24*b* of the pad member 24, but not in contact with the depression 25 area. Further, the arm sections 24*b* contact with only both side portions of the sliding film.

Generally, a pressure is locally applied onto the film in the area near the opening. In the embodiment, however, small parts of the film being taken out contacts with the pad member in the area, so that the friction resistance produced is small, thus permitting a smooth sliding of the film. Furthermore, the central part of the film is free from the friction because of the presence of the depression 25, and therefore is free from the undesirable scratches. This effect is further enhanced since the peripheral edges of the arm sections 24*b*, particularly the free ends of the arm sections 24*b*, are sufficiently rounded, as shown in FIG. 3.

As seen from the foregoing, the sheet film when taken out is sufficiently protected from being scratched on the film surface and blackened, compared to the conventional magazine not with the resilient pad on the top plate.

It should be understood that the resilient pad member is not limited to the U-shaped one like that of the above-mentioned embodiment and the use of any other suitable shape of the pad member is allowable so long as it can effect the above-mentioned function essential to the invention.

What is claimed is:

1. A film containing magazine for containing a number of sheet films in a stack for use in an X-ray photographing machine, comprising:

(a) top and bottom walls and paired side walls arranged along the longitudinal axis of the magazine, and front and back walls arranged crosswise of the longitudinal axis, those components cooperatively defining a space containing a number of films;

(b) an opening formed in the top wall near said front wall, through which sheet films are taken in and out;

(c) a plate like resilient buffering member mounted on the inner surface of said top wall, said buffering member including a pair of spaced arm sections extending longitudinally of said magazine and to said opening.

2. A film containing magazine according to claim 1, in which said resilient buffering member has a base section, said arm sections extending angularly from the end portions of one side of the base section and being disposed parallel with each other, thereby to form a substantially U-shaped configuration.

3. A film containing magazine according to claim 1 in which said arm sections each have a fixed width, one of said arm sections being disposed close to one of said side walls and the other section close to the other side wall.

4. A film containing magazine according to claim 1, further comprising a number of engaging elements which are planted in said front wall, engageable with one end edge of the film stack, and obliquely directed toward said bottom wall.

5. A film containing magazine according to claim 4, further comprising urging means for urging said sheet film stack against said resilient member.

6. A film containing magazine for containing a number of sheet films in a stack for use in an X-ray photographing machine, comprising:

(a) a parallelepiped magazine casing with the longitudinal axis having inner and outer top plates, bottom plates and paired side plates, those being arranged along the longitudinal axis, front and back plates arranged crosswise of the longitudinal axis, and a lid plate disposed slidably between said inner and outer plates, said inner and outer plates having an opening for the passage of said sheet films which is disposed closer to said front plate and is closable by said lid plate; and (b) a plate like resilient pad bonded to the inner surface of said inner top plate, said resilient pad including a pair of spaced arm sections extending longitudinally of said magazine and to said opening.

7. A film containing magazine according to claim 6, in wich said resilient pad includes sponge rubber material and a film coated with Teflon for wrapping said sponge rubber material.

8. A film containing magazine according to claim 6 or 7, said resilient pad includes a base section disposed crosswise with respect to the longitudinal axis, said arm sections extending from the end portions of one side of said section substantially orthogonal to the latter and along the longitudinal axis, said arm sections and said base section forming a substantially U-shaped configuration.

9. A film containing magazine according to claim 7 or 8, further comprising a number of engaging elements which are planted in said front wall, engageable with one edge of the film stack, and obliquely directed toward said bottom wall.

10. A film containing magazine according to claim 9, further comprising a back-up plate disposed in said magazine casing, and spring means for urging said sheet film stack against said resilient pad.

* * * * *